United States Patent [19]

Vdoviak

[11] Patent Number: 4,887,425

[45] Date of Patent: Dec. 19, 1989

[54] FUEL SPRAYBAR

[75] Inventor: John W. Vdoviak, Marblehead, Mass.

[73] Assignee: General Electric Company, Lynn, Mass.

[21] Appl. No.: 169,696

[22] Filed: Mar. 18, 1988

[51] Int. Cl.[4] ..... F02K 3/10

[52] U.S. Cl. ..... 60/261; 60/742

[58] Field of Search ..... 60/261, 749, 742, 746, 60/739

[56] References Cited

U.S. PATENT DOCUMENTS

| | | | |
|---|---|---|---|
| 2,799,991 | 7/1957 | Conrad . | |
| 2,912,825 | 11/1959 | Blackman, Jr. et al. | 60/749 |
| 2,920,445 | 1/1960 | Bailey | 60/261 |
| 2,927,423 | 3/1960 | Wisniowski | 60/261 |
| 2,969,925 | 1/1961 | Burgess et al. . | |
| 2,978,870 | 4/1961 | Vdoviak . | |
| 3,009,317 | 11/1961 | Meyer et al. | 60/261 |
| 3,016,704 | 1/1962 | Duncan et al. | 60/261 |
| 3,176,465 | 4/1965 | Colley, Jr. | 60/749 |
| 3,698,186 | 10/1972 | Beane et al. | 60/261 |
| 3,765,178 | 10/1973 | Hufnagel et al. | 60/261 |
| 3,800,530 | 4/1974 | Nash | 60/261 |
| 4,423,595 | 1/1984 | McLean | 60/749 |
| 4,461,146 | 7/1984 | DuBell | 60/261 |
| 4,798,048 | 1/1989 | Clements | 60/261 |
| 4,817,378 | 4/1989 | Giffin, III et al. | 60/261 |

*Primary Examiner*—Donald E. Stout

*Attorney, Agent, or Firm*—Francis L. Conte; Jerome C. Squillaro

[57] ABSTRACT

The present invention comprises a gas turbine engine augmentor including a new and improved fuel spraybar therein. The spraybar includes a base having a manifold for receiving fuel, and a plurality of fuel tubes extending from the base and in flow communication with the manifold. The invention further includes means for cooling the fuel tubes for allowing independent thermal movement between the cooling means and the fuel tubes. In one embodiment of the invention, the cooling means comprises an elongate shield disposed upstream of the fuel tubes to block direct impingement of combustion gases against the fuel tubes while channeling a cooling fluid such as air over the fuel tubes.

In accordance with another embodiment, the invention includes means for securing the shield to the fuel tubes for allowing unrestrained longitudinal thermal movement while restraining lateral movement therebetween beyond a predetermined amount.

In yet another embodiment, the invention includes means for laterally dispersing fuel from discharge ports disposed in the fuel tubes. The means may include a delta wing.

31 Claims, 5 Drawing Sheets

FUEL SPRAYBAR

BACKGROUND OF THE INVENTION

The invention relates generally to fuel injectors for gas turbine combustors, and, more specifically, to an improved fuel spray bar for an augmentor of a gas turbine engine.

In a gas turbine engine having an augmentor, or afterburner, disposed downstream of a gas generator for providing additional thrust when desired, fuel spraybars, or injectors, are utilized for injecting fuel into the augmentor to be mixed with gases discharged from the gas generator. Generally, it is desirable that the spraybars provide a fuel discharge port for about each square inch of augmentor combustion area, which therefore typically requires a large number of such spraybars.

One form of improved spray bar is disclosed in U.S. Pat. No. 2,978,870—Vdoviak, assigned to the present assignee, which includes a plurality of fuel tubes of different lengths for positioning fuel discharge orifices at radially different positions, as well as for providing additional benefits. A plurality of relatively short and long spraybars is typically circumferentially spaced around an augmentor liner to provide a relatively uniform discharge of fuel therein.

Gas turbine engine performance may be made to increase by increasing turbine gas temperatures, which increases the metal temperature of the spraybars subject to such turbine gases and increases the tendency for preignition of the fuel/gas mixture between the spray bar and the flameholders disposed downstream therefrom. Accordingly, the distance between the spraybars and the flameholders may be decreased to avoid the preignition tendency. However, decreasing this fuel mixing distance then requires increased lateral distribution of fuel from the spraybars in the relatively shorter distance between the spraybars and the flameholders to ensure a uniform dispersion of fuel at the flameholders.

Yet further, during "wet" operation of a conventional augmented engine fuel flows through the spraybar and thereby cools the spraybar. However, this cooling occurs only during such wet operation. In order to ensure a useful life of a spraybar operated under higher-than-conventional turbine exit gas temperatures and during "dry" (unaugmented) and low levels of wet operation of an augmented engine, cooling thereof may be utilized. However, undesirable thermal stress due to the interaction of the cooling fluid with the relatively hot spraybar should be avoided for obtaining a useful life thereof.

Accordingly, one object of the present invention is to provide a new and improved fuel spraybar for a gas turbine engine.

Another object of the invention is to provide a fuel spraybar for a gas turbine engine augmentor having means for cooling the spraybar to allow for increased gas temperatures in the gas turbine engine.

Another object of the invention is to provide a fuel spraybar for a gas turbine engine augmentor having means for cooling the spraybar which accommodates differential thermal expansion and contraction.

Another object of the invention is to provide a spraybar having means for laterally dispersing fuel.

Another object of the invention is to provide a spraybar having means for laterally dispersing fuel with minimal pressure losses therefrom.

SUMMARY OF THE INVENTION

The present invention comprises an improved fuel spraybar for a gas turbine engine comprising a base, a plurality of fuel tubes extending therefrom, and means for cooling the fuel tubes. The cooling means is spaced from the fuel tubes for allowing independent thermal movement between the cooling means and the fuel tubes.

In accordance with another embodiment of the invention, the fuel spraybar includes means for laterally dispersing fuel from the fuel tubes, which, in one embodiment, includes a delta-shaped member pitched for generating vortices.

In accordance with another embodiment of the invention, the fuel spraybar includes means for securing the cooling means to the fuel tubes for allowing unrestrained longitudinal thermal movement therebetween while restraining lateral movement therebetween.

BRIEF DESCRIPTION OF THE DRAWINGS

The novel features believed characteristic of the invention are set forth in the appended claims. The invention, in accordance with preferred embodiments, together with further objects and advantages thereof, is more particularly described in the following detailed description taken in conjunction with the accompanying drawings, in which:

DETAILED DESCRIPTION

Figure 1:
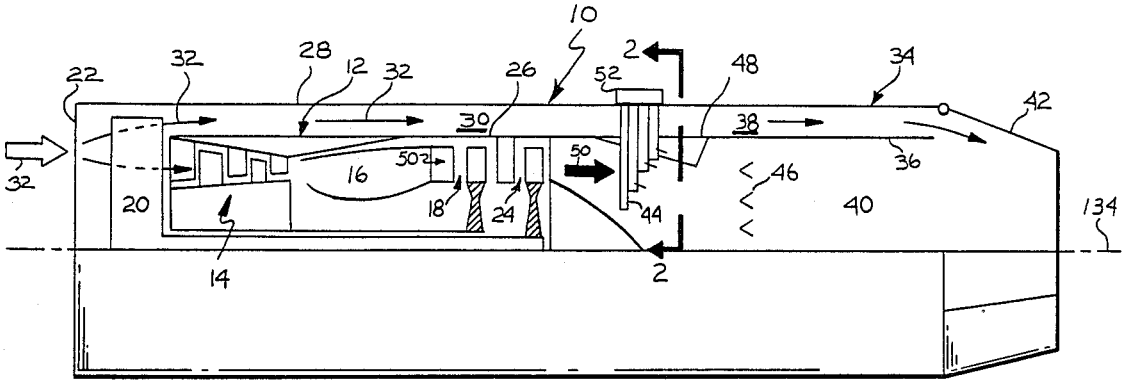
FIG. 1 is a schematic representation of a gas turbine engine including an augmentor in accordance with one embodiment of the present invention.

Illustrated in FIG. 1 is a schematic representation of a gas turbine engine 10 having a conventional gas generator 12 including a compressor 14, combustor 16 and high pressure turbine (HPT) 18, which drives the compressor 14. The engine 10 further includes a conventional fan 20 disposed upstream of the compressor 14, and an inlet 22 for receiving ambient air. The fan 20 is rotatably connected to a low pressure turbine (LPT) 24, which is disposed downstream of the HPT 18. The gas generator 12 is disposed within an annular inner casing 26, which is spaced radially inwardly from an engine outer casing 28 to define a bypass duct 30 for receiving a portion of fan air 32 from the fan 20, with the remaining portion of fan air being channeled into the compressor 14.

Disposed downstream of the gas generator 12 is an augmentor, or afterburner, 34, which includes a cooling liner 36 spaced radially inwardly from the outer casing 28 to define therebetween an annular cooling air passage 38. The liner 36 also defines therein a combustion zone 40. Pivotably connected to a downstream end of the outer casing 28 is a conventional variable exhaust nozzle 42.

The augmentor 34 further includes a plurality of circumferentially-spaced radially oriented fuel injectors, or spraybars, 44, in accordance with the invention. The spraybars 44 are conventionally fixedly mounted on the casing 28 at an upstream end of the liner 36 and are spaced upstream of a plurality of conventional flameholders, or stabilizers, 46. The spraybars 44 are conventionally connected to a source of fuel (not shown) and are effective for providing fuel upstream of the flameholders 46 for generating increased thrust output when desired. Disposed between the gas generator 12 and the augmentor 34 and extending downstream from a downstream end of the inner casing 26 is a conventional lobed mixer 48.

In operation, air enters the inlet 22, a first portion of which bypasses the gas generator 12 through the bypass duct 30, and a second portion enters the compressor 14, where it is compressed and then channeled to the combustor 16 for mixing with fuel and for generating combustion gases 50. The relatively hot, high pressure gases 50 flow through the HPT 18, which rotates to power the compressor 14, and then flow through the LPT 24, which rotates to power the fan 20. The gases 50 are discharged from the gas generator 12, channeled past the spraybars 44 and mixed with fan air 32 from the mixer 48 in the augmentor 34. When thrust augmentation is desired, fuel is discharged from the spraybars 44 and mixed with the gases 50 and fan air 32 for further combustion in the combustion zone 40 downstream of the flameholders 46. A portion of the fan air 32 is channeled through the cooling air passage 38 and over the liner 36 for the cooling thereof and is discharged at a downstream end of the liner 36 and along the inner surface of the exhaust nozzle 42.

Figure 2:
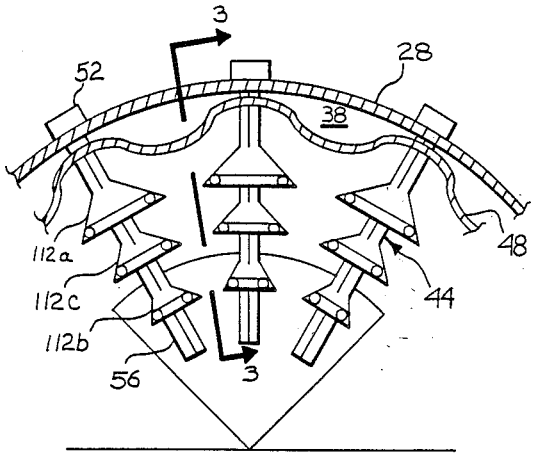
FIG. 2 is a quarter end view taken along line 2—2 of FIG. 1 illustrating three of many circumferentially-spaced spraybars in accordance with one embodiment of the present invention.
Figure 3:
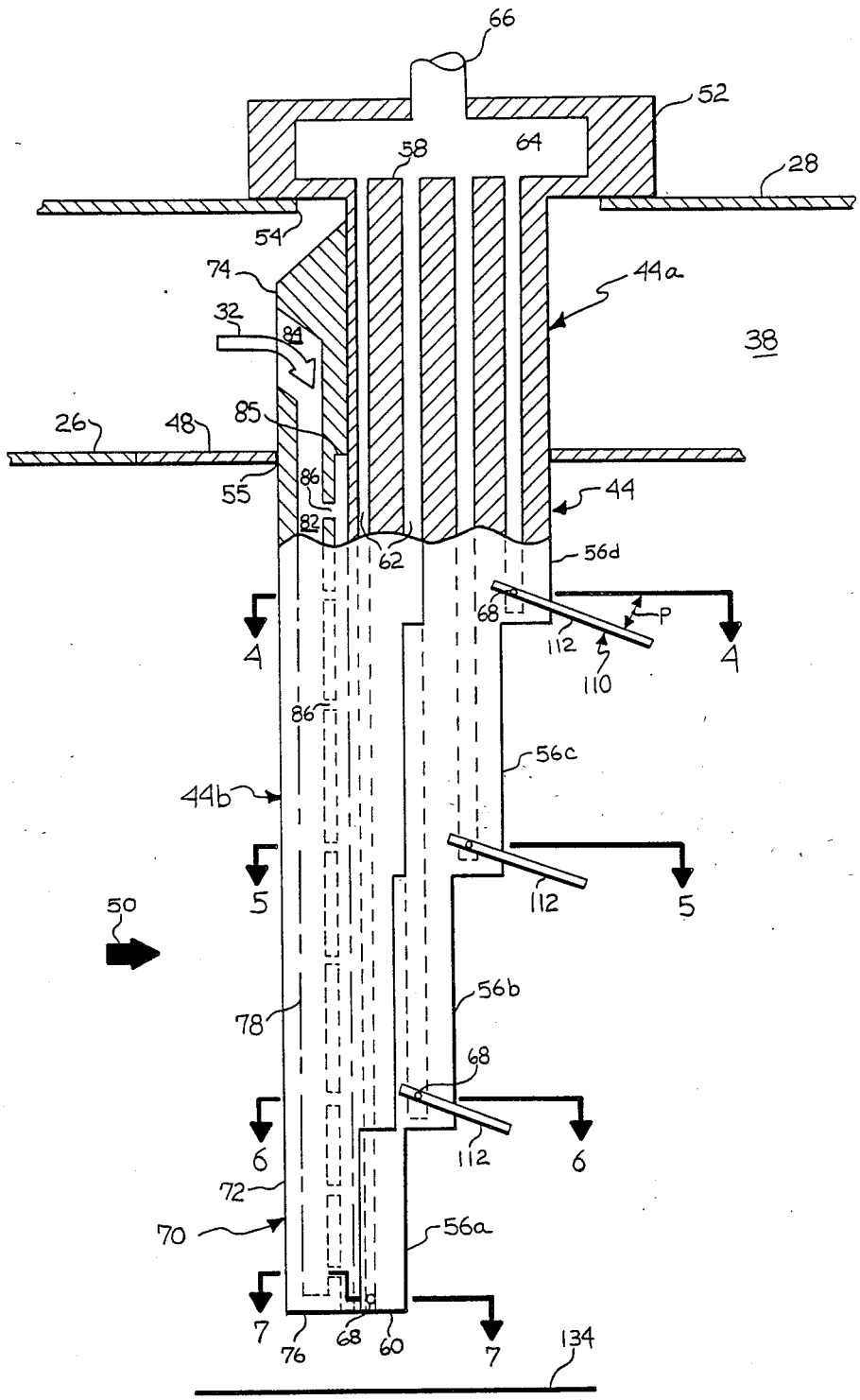
FIG. 3 is a side view, partly in section, taken along line 3—3 in FIG. 2 of a spraybar in accordance with one embodiment of the present invention.

Illustrated in more particularity in FIGS. 2–7 is the spraybar 44 in accordance with a preferred embodiment of the present invention. Referring to FIG. 3, for example, each spraybar 44 includes a base 52 mounted on the casing 28 and suitably secured thereto by conventional means, such as bolts, not shown. A plurality of fuel tubes 56 extends radially inwardly from the base 52 through an aperture 54 in the casing 28, across the cooling air passage 38 and then through an aperture 55 in the mixer 48. In the exemplary embodiment illustrated, the fuel tubes 56 comprise four fuel tubes: a first, upstream fuel tube 56*a*, followed in turn by a second fuel tube 56*b*, a third fuel tube 56*c*, and a fourth fuel tube 56*d*, each discharging fuel at the desired radial location.

Each fuel tube 56 has a proximate end 58 fixedly joined to the base 52, and an opposing, distal end 60, which is disposed radially inwardly of the mixer 48 and upstream of the flameholders 46. Each fuel tube 56 further includes a fuel passage 62 extending from the proximate end 58 to the distal end 60 therein, which is disposed in fluid communication with a common fuel manifold 64 disposed in the base 52. The manifold 64, in turn, is in fluid communication with a fuel inlet 66 of the base 52, which is suitably connected to a conventional source of fuel of the engine 10 (not shown). Each tube distal end 60 includes at least one fuel discharge port 68, with two being shown in a preferred embodiment, in fluid communication with the respective fuel passage 62 thereof.

The fuel tubes 56 are of varying length with the first fuel tube 56*a* being longest, followed in turn by relatively shorter fuel tubes 56*b*, 56*c*, and 56*d* being the shortest. Accordingly, the respective fuel discharge ports 68 of the fuel tubes 56 are disposed at different radial positions inside the liner 36 for dispersing fuel more uniformly therein.

In accordance with one embodiment of the invention, the spraybars 44 include means 70 for cooling the fuel tubes 56 during both wet and dry operation of the engine 10 when fuel flow through the spraybars 44 is on or off, respectively. Since an augmented engine is typically operated primarily dry during its useful life, cooling of the spraybars 44, other than by the flow of fuel therethrough, is one means to ensure a more useful life of spraybars 44 subject to relatively hot gases 50. However, since the spraybars 44 are relatively long, and subject to relatively hot gases 50, and a coolant is relatively cold, thermal distortion and stress should be minimized for obtaining a more useful life of the spraybars 44. To accomplish this objective, the cooling means 70 extends from near the base 52 and is spaced from the fuel tubes 56 for allowing independent thermal movement between the cooling means 70 and the fuel tubes 56 and for obtaining independent and substantially unrestrained thermal expansion and contraction between it and the fuel tubes 56. Although the fuel tubes 56 are shown as an integral assembly, preferably cast, they may also be fabricated and conventionally assembled together; but, in either embodiment, they are not fixedly connected to the cooling means 70 radially inwardly of the mixer 48 where the hot gases 50 are channeled to allow for such unrestrained differential movement therebetween.

As illustrated in more particularity in FIGS. 3–7, the cooling means 70 includes an elongate shield 72 spaced upstream of the first fuel tube 56*a*, which has a proximate end 74 fixedly connected to the proximate end 58 of the first fuel tube 56*a* within the cooling air passage 38. The shield 72 could alternatively be fixedly connected directly to the base 52.

The shield 72 further includes a distal end 76, opposite to the proximate end 74, which is spaced from the distal end 60 of the first fuel tube 56*a*. The shield 72 is shaped to block the fuel tubes 56 from direct impingement thereagainst of the gas turbine engine gases 50 flowable therepast. The shield 72 preferably has a forward facing surface 78, which blocks direct line-of-sight viewing of the fuel tubes 56 to shield the fuel tubes 56 from the gases 50. Preferably, the shield 72 and the forward surface 78 are generally U-shaped and symmetrical and include a leading edge 80 facing upstream. The shield 72 is relatively aerodynamically smooth and is airfoil-shaped to provide a relatively low coefficient of drag for reducing pressure losses associated therewith.

Accordingly, the use of the shield 72 by itself blocks direct impingement of the gases 50 against the fuel tubes 56 for providing at least some cooling of the fuel tubes 56.

In accordance with another feature of the invention, the cooling means 70 further includes a fluid passage 82 extending therein from the proximate end 74 to the distal end 76 of the shield 72 for channeling a cooling fluid therethrough. The passage 82 is disposed in fluid communication with a cooling fluid inlet 84 disposed in the proximate end 74. As illustrated, the inlet 84 comprises a simple aperture facing upstream in the cooling air passage 38 for receiving a portion of the fan air 32 for channeling through the passage 82.

The shield distal end 76 is preferably spaced from the first fuel tube **56*a* along its entire length to its intersection 85 with the proximate end 74, which, as shown in the exemplary embodiment illustrated in FIG. 3, is located at the aperture 55 of the mixer 48. It will be noted that an outer portion 44*a* of the spraybar 44, including the proximate end 74, is disposed within the cooling passage 38 and is exposed to cooling fan air 32, whereas an inner portion 44*b* of the spraybar 44, including the distal end 76, is disposed radially inwardly of the mixer 48 and is exposed to the hot gases 50. Since the spraybar outer portion 44*a* is subject to the fan air 32, thermal movement thereof will be generally uniform. However, since the inner portion 44*b* is subject to the hot gases 50 and the shield 72 is cooled, the spacing between the shield 72 and the first fuel tube 56*a* allows for substantially unrestrained differential thermal expansion and contraction thereof, thus avoiding distortion and stress which would otherwise occur if the shield distal end 76 were fixedly attached to the first fuel tube distal end 60. The intersection 85 may be alternatively located either below or above the mixer aperture 55, depending on the particular design, provided that effective unrestrained differential movement is allowed between the shield 72 and the first fuel tube 56*a***.

The shield 72 further includes a plurality of longitudinally-spaced discharge orifices 86 disposed in fluid communication with the passage 82 for channeling the cooling air 32 from the passage 82 and over the fuel tubes 56. More specifically, the orifices 86 are spaced from and face a leading edge 88 of the first fuel tube **56*a*, which is the forwardmost fuel tube. The orifices 86 are sized for providing impingement cooling of the first fuel tube 56*a* at the leading edge 88**.

Figure 4:
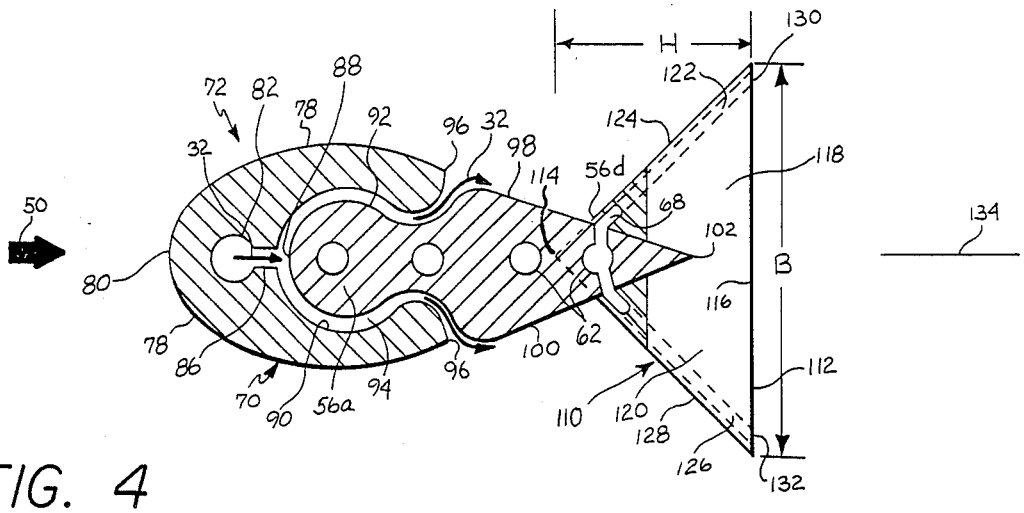
FIG. 4 is an enlarged sectional view of the spraybar illustrated in FIG. 3 taken along line 4—4.

Referring to FIG. 4, for example, the cooling means 70 further includes an inner, or generally aft facing, surface 90 of the shield 72, which is generally U-shaped and spaced upstream of a complementary generally forward facing surface 92 of the fuel tubes 56 to define a space or channel 94 therebetween. The channel 94 is in flow communication with the discharge orifices 86 and receives air first used for impingement cooling of the leading edge 88. This air then flows through the channel 94 and will provide additional convection cooling of the inner surface 90 and the forward surface 92. The channel 94 ends at aft-inclined discharge slots 96 defined between the shield 72 and the fuel tubes 56, and sized and configured for providing a film of cooling air from the slots 96 downstream along oppositely facing first and second side surfaces 98 and 100, respectively, of the trailing edge portion of the fuel tubes 56. The first and second side surfaces 98, 100 preferably converge to a trailing edge 102 and, along with the forward surface 92, define the entire outer surface of the fuel tubes 56. Collectively, the forward surface 78 of the shield 72 and the side surfaces 98, 100 define a symmetrical assembly having a relatively low coefficient of drag.

In accordance with another embodiment of the invention, the spraybar 44 further includes means 104 for securing the shield 72 to the fuel tubes 56 for allowing unrestrained longitudinal thermal movement therebetween while restraining excessive lateral movement therebetween. A preferred, exemplary embodiment of the securing means 104 will be described with respect to FIG. 5 but is also applicable with respect to FIGS. 4 and 6 as well.

The securing means 104 comprises the forward surface 92 of the fuel tubes 56 having a first, arcuate, dovetail shape and the inner surface 90 of the shield 72 having a second, arcuate, dovetail shape complementary to the first dovetail shape. The forward surface 92, and first fuel tube **56*a*, include a portion 106 of maximum width, and the shield 72 includes a throat portion 108 having a width less than the maximum width of the portion 106, which portion 108 is disposed downstream of the portion 106. In this arrangement, the shield 72 is allowed to expand and contract from its proximate end 74 without restraint by the fuel tubes 56 in the longitudinal direction due to the channel 94 between it and the fuel tubes 56. However, the above-described dovetail arrangement will allow for unrestrained lateral movement (e.g. expansion and contraction) between the shield 72 and the fuel tubes 56 while restraining excessive movement beyond the predetermined amount of the extent of the channel 94 once the space formed by the channel 94 is eliminated due to any lateral movement between the shield 72 and the fuel tubes 56**, which results in contact therebetween.

Figure 5:
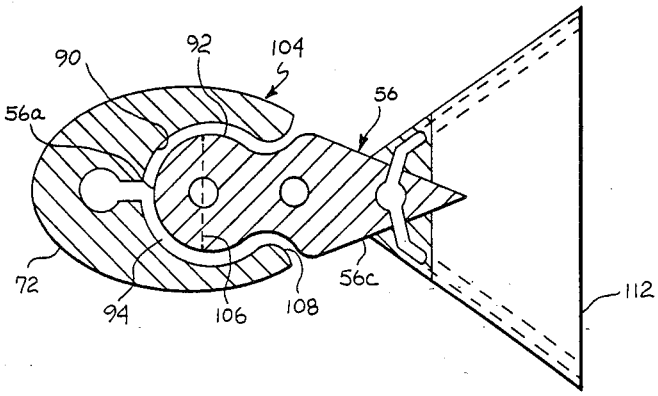
FIG. 5 is a sectional view of the spraybar illustrated in FIG. 3 taken along line 5—5.
Figure 6:
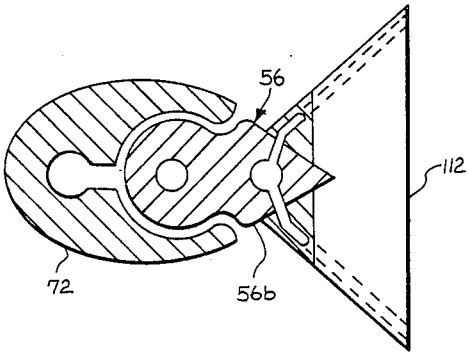
FIG. 6 is a sectional view of the spraybar illustrated in FIG. 3 taken along line 6—6.
Figure 7:
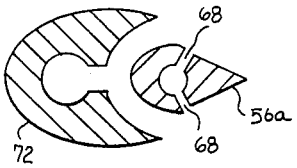
FIG. 7 is a sectional view of the spraybar illustrated in FIG. 3 taken along line 7—7.

Accordingly, the shield 72 is unrestrained in the lateral direction until the inner surface 90 contacts the forward surface 92, in which event lateral restraint will be effected. The dovetail-shaped arrangement disclosed in FIG. 5 is similar at all sections of the second, third and fourth fuel tubes **56*b*, 56*c* and 56*d* to the fuel tube section at the intersection 85 as shown in FIGS. 3–6. However, the dovetail arrangement may also be alternatively used at only selected portions of the fuel tubes 56**, if desired.

In yet another embodiment, the invention includes means 110 for laterally dispersing fuel from the discharge port 68 of at least one of the fuel tubes 56, as shown in FIG. 3, for example. Conventional spraybars simply discharge fuel through a discharge port like the port 68 in the first fuel tube **56*a*. Fuel from the discharge port 68 mixes with combustion gas flowable over the spraybar 44 and is entrained therewith. However, by utilizing the dispersing means 110, which is effective for laterally dispersing fuel in a radial direction, or circumferential direction, or both, fewer spraybars may be utilized in an augmentor and/or they may be disposed closer to the flameholders 46** for providing additional advantages in lateral fuel distribution and increased efficiency, for example.

The lateral dispersing means 110 comprises, in a preferred embodiment of the invention, a half delta wing and T-bar 112, or simply half delta wing 112. The half delta wing 112 includes an apex 114 formed integral to and fixedly connected to the fuel tubes 56 near the trailing edge 102. The wing 112 further includes a base 116 cantilevered from the fuel tubes 56 at the apex 114. The wing 112 further includes a first side 118 extending laterally and aft from the first side surface 98 near the apex 114 and extending to the base 116, and a second side 120 extending laterally and aft from the second side surface 100 from near the apex 114 to the base 116.

The half delta wing 112 in the preferred embodiment illustrated in FIGS. 2–6 is substantially solid and further includes a first fuel passage 122 extending therein and adjacent to a first leading edge 124 of the first side 118 in flow communication with the discharge port 68 of the fuel passage 62 of the respective fuel tube 56. The wing 112 similarly includes a second fuel passage 126 extending therein adjacent to a second leading edge 128 of the second side 120 in flow communication with the discharge port 68 of the fuel passage 62 of the respective fuel tube 56. The first and second passages 122 and 126 extend to the base 116 and define therein first and second discharge ports 130 and 132, respectively, which face in an aft direction. The wing 112 is considered a half delta because it is in the general shape of a triangle having a height H which is equal to about one-half its base B, and it is further characterized as being a T bar because of the two laterally extending fuel passages 122 and 126 disposed therein.

Inasmuch as the delta wing 112 includes laterally extending wing-type members, i.e. first side 118 and second side 120, the flow of gases 50 thereover, which is primarily in a direction parallel to an axial axis 134 of the augmentor 34, will include a lateral component which will tend to follow the leading edges 124 and 128 as would occur in an aircraft wing. This behavior can be utilized for assisting in laterally dispersing fuel discharged from the ports 130 and 132 in circumferential and radial directions.

To further enhance lateral dispersion of fuel in the circumferential and radial directions, the delta wing 112 is predeterminedly pitched radially inward at an angle P relative to the axial axis 134, as shown in FIG. 3, so that the apex 114 is disposed in the augmentor 34 at a larger radius than the base 116. Unlike a conventional aircraft wing wherein stall is undesirable, the pitch angle P may be conventionally selected to ensure the generation of at least some aerodynamic stall of the gas turbine engine gases 50 flowable over the wing 112 for predeterminedly creating vortices which will entrain fuel discharged from the ports 130 and 132 for enhancing lateral dispersion of the fuel discharged therefrom. In several tested embodiments, pitch angles P of about 10 and 20 degrees were utilized to effectively create the vortices.

Figure 8:
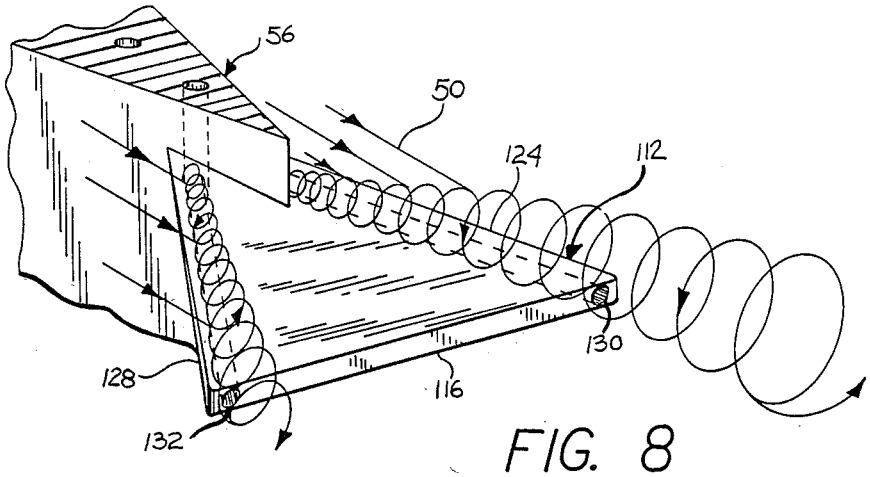
FIG. 8 is a perspective view of a delta wing element of one embodiment of the invention illustrating the formation of vortices thereover.

Illustrated in FIG. 8 is one of the half delta wings 112 illustrating respective vortices believed to be generated along both the first and second leading edges 124 and 128 thereof. At the base 116 the vortices have grown in both radial and circumferential extent and are, therefore, effective for laterally dispersing fuel in both a radial and circumferential direction, which fuel is entrained therewith from the discharge ports 130 and 132.

As illustrated more clearly in FIG. 2, the delta wings 112 preferably vary in size to provide varying lateral dispersion of fuel. The delta wing 112*a* closest to the base 52 is largest with the delta wing 112*b* at the radially inwardly-most position being the smallest, with the wing 112*c* therebetween being an intermediate size. This arrangement allows for the most lateral dispersion at the larger radius of the augmentor where the circumference between adjacent spraybars 44 is largest. As the spraybars 44 are closer at radially inwardly positions therefrom, less lateral dispersion is required and, therefore, the delta wings 112*b* may be smaller.

As illustrated in FIGS. 3–6, it will be noted that the delta wings 112 are substantially similar, but vary simply in scale. Respective delta wings are in flow communication with respective discharge ports 68 of the fuel tubes 56*b*, 56*c*, and 56*d*.

Figure 9:
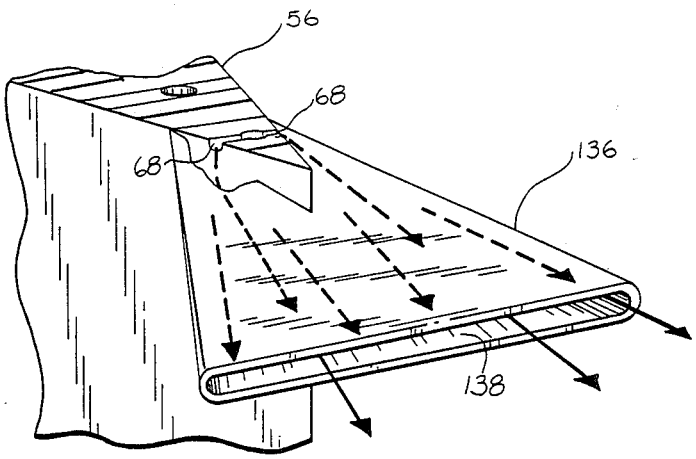
FIG. 9 is a perspective view of a delta wing in accordance with another embodiment of the present invention.

Illustrated in FIG. 9 is another embodiment of the invention comprising a half delta wing 136, which is substantially hollow and suitably pitched for generating vortices. In this embodiment, the discharge ports 68 are in direct flow communication with the interior of the delta wing 136 and fuel is dischargeable through a single elongate discharge port 138 extending substantially the full width of the base of the delta wing 136.

In both embodiments of the delta wing types illustrated in FIGS. 4–6 and FIG. 9, respectively, the delta wings may also be constructed to be full delta wings wherein the base B is substantially equal to the height H thereof.

Figure 10:
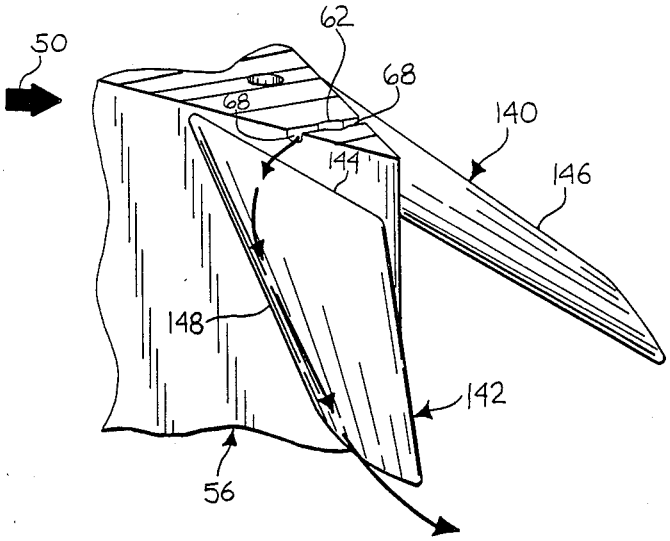
FIG. 10 is a perspective view of a pair of wings in accordance with another embodiment of the present invention.

Illustrated in FIG. 10 is yet another embodiment of the invention including first and second laterally extending, swept-back members or wings 140 and 142, respectively, each including a proximate end 144 fixedly secured to the fuel tubes 56. The wings 140 and 142 are spaced from and diverge from each other in a downstream direction. The discharge port 68 connected to the fuel passage 62 is disposed over and is spaced from the proximate ends 144 of the wings 140 and 142. In this embodiment of the invention, fuel is discharged from the port 68 over the wings 140 and 142 and is entrained by the gases 50 flowable thereover, a portion of which will flow laterally along leading edges 146 and 148 of the wings 140 and 142, respectively.

Figure 11:
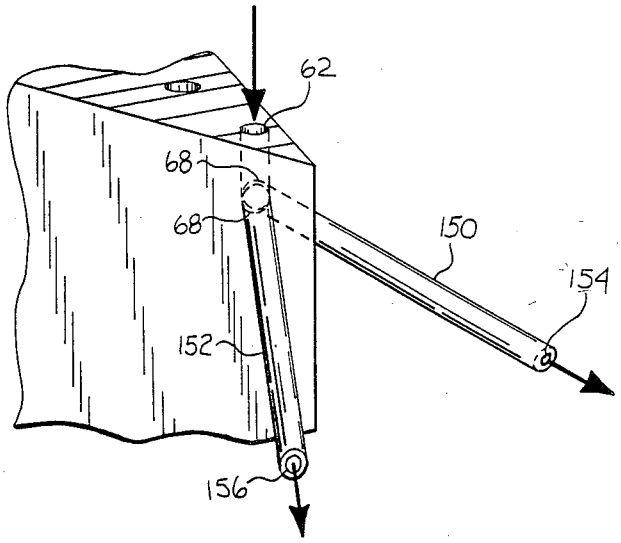
FIG. 11 is a perspective view of a pair of hollow T bar tubes in accordance with another embodiment of the present invention.

In yet another embodiment of the invention illustrated in FIG. 11, first and second cylindrical, hollow tubes or T-bars 150 and 152 are fixedly attached at one end to respective discharge ports 68 of a fuel passage 62. The T bars 150 and 152 diverge from each other in a downstream direction for laterally dispersing fuel through first and second discharge ports 154 and 156, respectively. However, the tubes 150 and 152 simply channel fuel to their ends for dispersion and do not enjoy the additional dispersion of fuel due to the vortices generated by the delta wings described above.

Figure 12A:
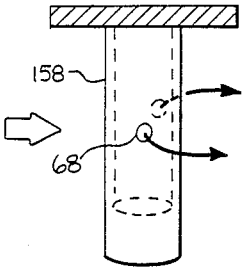
FIG. 12 illustrates in views A, B, C, D and E several spraybar embodiments tested for comparing fuel dispersing ability.
Figure 12B:
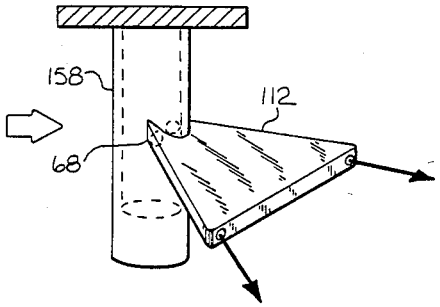
Figure 12C:
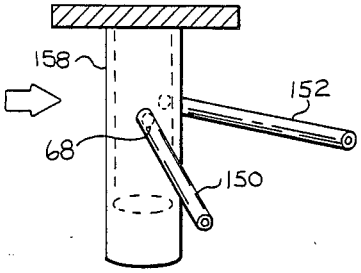
Figure 12D:
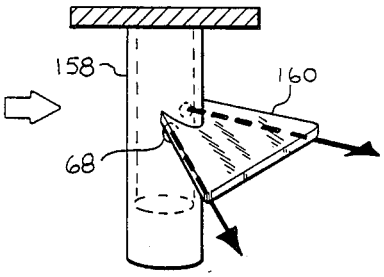
Figure 12E:
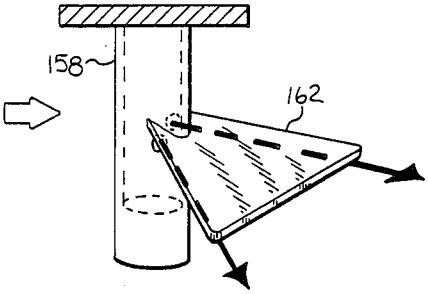

Model tests in a low temperature wind tunnel were conducted of a plane, cylindrical spraybar 158 as shown in FIG. 12A, used as the common element; two models of the half delta with T-bar 112 having pitch angles of 10 and 20 degrees and connected to the plane spraybar 158, as shown in FIG. 12B; the T bars 150 and 152 connected to the plane spraybar 158, as shown in FIG. 12C; and a half delta 160 and full delta 162, each connected to the plane spraybar 158 at a pitch of 20 degrees and where the fuel discharge ports 68 were simply positioned under the apex portion of the models as shown in FIGS. 12D and 12E.

One factor used to evaluate the spraybar performance, designated benefit, may be obtained by dividing the fuel-spreading pattern area at a common downstream location by the total pressure loss due to the tested structures of FIG. 12. A normalized benefit may be obtained by subtracting the benefit value for the plane spraybar 158 of FIG. 12A from the benefit value of each of the tested embodiments and dividing by the plane spraybar 158 benefit. The results of the tests showed that the half delta and T-bar model of FIG. 12B was best and provided about a 93% benefit increase over the plane spraybar 158. The half delta 160 of FIG. 12D was second best at about 25%, and the full delta of FIG. 12E and T-bars 150/152 of FIG. 12C were about equal at 12%.

Of course, similar performance comparison would be expected if the plane spraybar 158 of FIG. 12 were replaced by the more streamlined fuel tubes 56 and shield 72 of FIG. 3.

While there have been described herein what are considered to be preferred embodiments of the invention, other modifications will occur to those skilled in the art from the teachings herein. It is, therefore, desired to secure in the appended claims all such modifications as fall within the true spirit and scope of the invention.

For example, although the cooling means 70 is operable during both wet and dry operation of the engine 10, it may be suitably configured to operate solely during dry operation, if desired. Although the spraybars 44 are preferably mounted at the upstream end of the mixer 48 to allow the hot gases 50 to mix with and vaporize fuel received therefrom prior to mixing with the fan air 32 from the mixer 48, they may also be disposed between the mixer 48 and the flameholders 44 and mounted through the liner 36.

What is claimed as novel and desired to be secured by Letters Patent of the United States is:

1. A fuel spraybar for a gas turbine engine comprising:

a base including a manifold for receiving fuel;

a plurality of fuel tubes extending from said base and including a trailing edge portion defined by side surfaces of said fuel tubes joined at a trailing edge, each fuel tube having a distal end, a proximate end fixedly joined to said base, a fuel passage disposed in fluid communication with said manifold, and a discharge port disposed in said tube distal end of said trailing edge portion in flow communication with said fuel passage;

means for cooling said fuel tubes including said distal ends, spaced from said fuel tubes for allowing independent thermal movement between said cooling means and said fuel tubes; and said fuel tubes and said cooling means being positionable together in combustion gases in the gas turbine engine with said trailing edge portion being directly exposed to said combustion gases.

2. A fuel spraybar according to claim 1 wherein said cooling means comprises an elongate shield spaced from said fuel tubes and having a distal end and a proximate end fixedly joined to a proximate end of an upstream one of said fuel tubes, said shield being shaped to block said fuel tubes from direct impingement of gas turbine engine gases flowable therepast.

3. A fuel spraybar according to claim 2 wherein said shield includes a fluid passage extending from said proximate end toward said distal end thereof for channeling a cooling fluid therethrough, said shield further including a plurality of longitudinally-spaced discharge orifices disposed in fluid communication with said fluid passage for channeling cooling fluid over said fuel tubes.

4. A fuel spraybar according to claim 3, further including means for providing film cooling of at least one of said fuel tubes using cooling fluid discharged from said orifices.

5. A fuel spraybar according to claim 3 wherein said discharge orifices face a leading edge of said upstream fuel tube for providing impingement cooling thereof.

6. A fuel spraybar according to claim 5, further including means for providing film cooling of at least one of said fuel tubes using cooling fluid used for impingement cooling of said upstream fuel tube.

7. A fuel spraybar according to claim 6 wherein said film-cooling means comprises a channel defined between said shield and said upstream fuel tube ending in a discharge slot sized and configured for channeling cooling fluid as a film along first and second side surfaces of said fuel tubes converging to a trailing edge thereof.

8. A fuel spraybar according to claim 6, further including means for securing said shield to said fuel tubes for allowing unrestrained longitudinal thermal movement therebetween.

9. A fuel spraybar according to claim 8 wherein said securing means comprises a forward surface of said fuel tubes having a first dovetail shape and said shield including an inner surface having a second dovetail shape complementary to said first dovetail shape, said forward and inner surfaces being spaced from each other to define a channel for channeling therethrough cooling fluid from said discharge orifices.

10. A fuel spraybar according to claim 9 wherein said first and second dovetail shapes are arcuate.

11. A fuel spraybar according to claim 8, further including means for laterally dispersing fuel from said discharge port of at least one of said fuel tubes.

12. A fuel spraybar according to claim 11 wherein said one fuel tube includes oppositely-facing first and second side surfaces converging toward and intersecting at a trailing edge, and including first and second discharge ports, respectively, in fluid communication with said fuel passage of said one fuel tube, and said dispersing means includes a member laterally extending from each of said discharge ports.

13. A fuel spraybar according to claim 12 wherein said laterally extending member comprises a delta wing having an apex fixedly attached to said side surfaces adjacent to said discharge ports and including one side extending from said first side surface and a second side extending from said second side surface, said delta wing also having a cantilevered base, said delta wing being disposed at a pitch angle relative to a plane normal to a longitudinal axis of said spraybar, said pitch angle selected to ensure at least some aerodynamic stall of gas turbine engine gases flowable thereover for creating vortices for enhancing lateral dispersion of fuel dischargeable from said discharge ports.

14. A fuel spraybar according to claim 1 further including means for laterally dispersing fuel from said discharge port of at least one of said fuel tubes.

15. A fuel spraybar according to claim 14 wherein said one fuel tube includes oppositely-facing first and second side surfaces converging toward and intersecting at said trailing edge, and including first and second discharge ports, respectively, in fluid communication with said fuel passage of said one fuel tube, and said dispersing means includes a member laterally extending from each of said discharge ports.

16. A fuel spraybar according to claim 15 wherein said laterally extending member comprises a delta wing having an apex fixedly attached to said side surfaces adjacent to said discharge ports and including one side extending from said first side surface and a second side extending from said second side surface, said delta wing also having a cantilevered base, said delta wing being disposed at a pitch angle relative to a plane normal to a longitudinal axis of said spraybar, said pitch angle selected to ensure at least some aerodynamic stall of gas turbine engine gases flowable thereover for creating vortices for enhancing lateral dispersion of fuel dischargeable from said discharge ports.

17. A fuel spraybar according to claim 16 wherein said delta wing has a base length substantially equal to a height from said base to said apex.

18. A fuel spraybar according to claim 16 wherein said delta wing has a base length equal to about one-half the height from said base to said apex.

19. A fuel spraybar according to claim 16 wherein said discharge port is disposed over said delta wing.

20. A fuel spraybar according to claim 16 wherein said delta wing is hollow and said discharge port is disposed inside said apex.

21. A fuel spraybar according to claim 16 wherein said delta wing is substantially solid and includes a first passage extending along an edge of said first side from said base to said apex in flow communication with said first discharge port, and a second passage extending along an edge of said second side from said base to said apex in flow communication with said second discharge port.

22. A fuel spraybar according to claim 16, further including a plurality of said delta wings disposed with respective ones of said fuel tubes in flow communication with respective ones of said discharge ports.

23. A fuel spraybar according to claim 22 wherein said delta wings vary in size to provide varying lateral dispersion of said fuel.

24. A fuel spraybar according to claim 23 wherein said delta wing closest to said base is largest.

25. A fuel spraybar according to claim 15 wherein said laterally extending member comprises a swept wing.

26. A fuel spraybar according to claim 15 wherein said laterally extending member comprises a hollow tube in flow communication with a respective discharge port.

27. A gas turbine engine augmentor comprising:

an outer casing:

an annular cooling liner spaced radially inwardly from said casing to define a cooling air passage therebetween for receiving fan air from a gas turbine engine;

a plurality of flameholders disposed radially inwardly of said liner; and a plurality of circumferentially-spaced fuel spraybars disposed upstream of said flameholders and extending radially inwardly from said casing, each of said spraybars comprising:

a base fixedly attached to said casing and including a manifold for receiving fuel;

a plurality of fuel tubes extending from said base and through said liner and including a trailing edge portion defined by side surfaces of said fuel tubes joined at a trailing edge, each fuel tube having a distal end, a proximate end fixedly joined to said base, a fuel passage disposed in fluid communication with said manifold, and a discharge port disposed in said tube distal end of said trailing edge portion in fluid communication with aid fuel passage; and means for cooling said fuel tubes spaced from said fuel tubes for allowing independent thermal movement between said cooling means and said fuel tubes and said fuel tubes and said cooling means being positioned together in the augmentor with said trailing edge portion being directly exposed to combustion gases flowable through the augmentor.

28. An augmentor according to claim 27, further including:

means for securing said cooling means to said fuel tubes for allowing unrestrained longitudinal thermal movement therebetween; and means for laterally dispersing fuel from said discharge port of at least one of said fuel tubes.

29. An augmentor according to claim 28 wherein:

said cooling means comprises an elongate shield having a proximate end fixedly joined to a proximate end of an upstream one of said fuel tubes, and a distal end spaced from a distal end of said upstream fuel tube, said shield being shaped to block said fuel tubes from direct impingement of gas turbine engine gases flowable therepast, said shield including an inlet in said proximate end facing upstream in said cooling air passage and a fluid passage extending from said inlet to said distal end thereof for channeling said cooling fluid therethrough, said shield further including a plurality of longitudinally-spaced discharge orifices disposed in fluid communication with said fluid passage for channeling cooling fluid over said upstream fuel tube;

said securing means is effective also for restraining lateral movement between said shield and said fuel tubes beyond a predetermined amount and comprises a forward surface of said fuel tubes having a first dovetail shape and said shield including an inner surface having a second dovetail shape complementary to said first dovetail shape, said forward surface and said inner surface being spaced from each other to define a channel for channeling therethrough cooling fluid from said discharge orifices; and said fuel tubes include oppositely-facing first and second side surfaces converging toward and intersecting at a trailing edge, and including first and second discharge ports, respectively, in fluid communication with said fuel passage of one of said fuel tubes, and said dispersing means includes a member laterally extending from said discharge ports.

30. An augmentor according to claim 29 wherein said laterally extending member comprises a delta wing having an apex fixedly attached to said side surfaces adjacent to said discharge ports and including one side extending from said first side surface and a second side extending from said second side surface, said delta wing also having a cantilevered base, said delta wing being disposed at a pitch angle relative to an axial axis of said augmentor, said pitch angle selected to ensure at least some aerodynamic stall of gas turbine engine gases flowable thereover for creating vortices for enhancing lateral dispersion of fuel dischargeable from said ports.

31. An augmentor according to claim 30, including a plurality of said delta wings disposed with respective ones of said fuel tubes in flow communication with respective ones of said discharge ports, said discharge ports and said delta wings being radially spaced from each other and said delta wings vary in size from a largest located closest to said base to provide varying lateral dispersion of said fuel.

* * * * *